US011111095B2

(12) United States Patent
Roberts et al.

(10) Patent No.: US 11,111,095 B2
(45) Date of Patent: Sep. 7, 2021

(54) METHOD AND APPARATUS FOR AUTOMATIC ADJUSTMENT OF FABRIC SUPPORT

(71) Applicant: Gerber Technology LLC, Tolland, CT (US)

(72) Inventors: Harrison Roberts, Willington, CT (US); Michael T. Silva, Enfield, CT (US); David A. Simm, Westfield, CT (US)

(73) Assignee: GERBER TECHNOLOGY LLC, Tolland, CT (US)

( * ) Notice: Subject to any disclaimer, the term of this patent is extended or adjusted under 35 U.S.C. 154(b) by 236 days.

(21) Appl. No.: 16/204,127

(22) Filed: Nov. 29, 2018

(65) Prior Publication Data

US 2019/0161310 A1 May 30, 2019

Related U.S. Application Data

(60) Provisional application No. 62/592,279, filed on Nov. 29, 2017.

(51) Int. Cl.
*B65H 16/08* (2006.01)
*B65H 23/182* (2006.01)
(Continued)

(52) U.S. Cl.
CPC ..... *B65H 23/1825* (2013.01); *B65H 16/028* (2013.01); *B65H 16/08* (2013.01);
(Continued)

(58) Field of Classification Search
CPC ..... B65H 16/028; B65H 16/08; B65H 16/10; B65H 16/106; B65H 49/32; B65H 59/04; B65H 23/1825
See application file for complete search history.

(56) References Cited

U.S. PATENT DOCUMENTS 3,537,662 A * 11/1970 Keesling ..... B65H 18/145 242/527.5
3,889,831 A 6/1975 Davis
(Continued)

FOREIGN PATENT DOCUMENTS

JP S5276261 A 6/1977
JP S55111342 A 8/1980

OTHER PUBLICATIONS

International Search Report and Written Opinion issued in corresponding international application No. PCT/US2018/063016, dated Mar. 13, 2019.

(Continued)

*Primary Examiner* — Sang K Kim
(74) *Attorney, Agent, or Firm* — Day Pitney LLP; Valeriya Svystun

(57) ABSTRACT

An apparatus and method for supporting sheet material, comprising a frame including a first arm and a second arm, the second arm in communication with the first arm to support a roll of the sheet material there-between, and a drive roller for transporting the sheet material from the roll. The first arm and the second arm automatically resize the frame corresponding to the dimensions of the roll of the sheet material to provide constant tension in the roll of sheet material by controlling a position of the roll of the sheet material.

20 Claims, 6 Drawing Sheets

(51) Int. Cl.

| | |
|---|---|
| ***B65H 16/02*** | (2006.01) |
| ***B65H 49/32*** | (2006.01) |
| ***B65H 59/04*** | (2006.01) |
| ***B65H 16/10*** | (2006.01) |

(52) U.S. Cl.
CPC ..... *B65H 16/10* (2013.01); *B65H 16/106* (2013.01); *B65H 49/32* (2013.01); *B65H 59/04* (2013.01); *B65H 2301/41376* (2013.01); *B65H 2301/41384* (2013.01); *B65H 2701/174* (2013.01)

(56) References Cited

U.S. PATENT DOCUMENTS 4,084,761 A * 4/1978 Kuckhermann ..... B65H 16/08 242/559
4,676,494 A * 6/1987 Smith ..... B65H 16/02 270/30.04
4,809,921 A 3/1989 Dueck et al.
5,029,827 A 7/1991 Smith et al.
5,326,041 A * 7/1994 Alexander, III ..... B65H 16/106 242/563
5,405,100 A * 4/1995 Cooper ..... B65H 16/02 242/541.3
5,699,980 A * 12/1997 Balsells Ventura .. B65H 16/106 242/564.5
2002/0139890 A1 10/2002 Toth

OTHER PUBLICATIONS

Gerber Technology, XLs50 Spreader brochure, Form No. 09032015, "Get Exceptional Quality and Performance in a Tension-Free Spreading System at an Affordable Price", Sep. 2015. (2 pgs.).
Gerber Technology, XLs125 Spreader brochure, Form No. 06202017, "Get Exceptional Quality and Performance in a Tension-Free Spreading System at an Affordable Price", Jun. 2017. (2 pgs.).

* cited by examiner

-- PRIOR ART --

METHOD AND APPARATUS FOR AUTOMATIC ADJUSTMENT OF FABRIC SUPPORT

CROSS-REFERENCE TO RELATED APPLICATIONS

This patent application claims the benefit of priority to U.S. Provisional Patent Application Ser. No. 62/592,279, filed on Nov. 29, 2017. The content of the referenced provisional patent application is incorporated herein by reference in its entirety for any purpose whatsoever.

BACKGROUND OF THE INVENTION

1. Field of the Invention

The invention disclosed herein relates to spreading and material feeding machines, cutting tables and other devices that manipulate sheet material, and in particular to systems for dispensing fabric from a roll of material.

2. Description of the Related Art

Sheet material such as cloth, laminates and the like is used in a variety of products. Included are garments, upholstery and many other products. High production volume necessitates efficient work practices with sophisticated equipment. Examples of equipment useful for preparing sheet material in the manufacturing process include cutting tables and spreaders. Generally, a spreader will spread the sheet material for subsequent cutting with the cutting table. The exceedingly competitive nature of such enterprises requires manufacturers to work quickly and make as much use as possible of the sheet material consumed.

Traditionally, when material is spread with an automatic spreading machine, the material is automatically dispensed from a supply in the cradle. Typically, the supply includes a roll of material. Substantial rolls of material are useful in production environments as less material handling is required. However, substantial rolls of material may be deformed under their own weight.

Inadequate support of the roll of material will result in compression of one side of the roll with loosening of the uncompressed side. As fabric is dispensed from the roll of material, the uncompressed sides of the roll can cause a surge of fabric, resulting in variations in in the spread material. Therefore this variation of roll compression causes poor quality spread resulting in reduced material utilization, and/or poor quality cut parts due to mis-aligned or mis-shapen parts. Typically, poor quality spreading is addressed by hand manipulation of one or more machine operators removing wrinkles and re-aligning mal-aligned fabric. While periodic reversal of the spreading machine permits a user to tighten up loose fabric, this is an imperfect solution A side from lost time in the production environment and cost of the extra labor, this solution does not result in a tightly wound roll of material and inevitably must be periodically repeated for each layer of fabric material spread.

Thus, what are needed are methods and apparatus to provide improved dispensing of sheet of material from a spreading machine. Preferably, the methods and apparatus may be supplied as part of a new spreading machine or as a retrofit to an existing spreading machine.

SUMMARY OF THE INVENTION

In one embodiment, a dynamic cradle for a spreader for spreading of sheet material includes adjustable elements and a control system. In another embodiment, a method for dispensing fabric from a roll of material calls for controlling a dynamic cradle.

BRIEF DESCRIPTION OF THE DRAWINGS

The features and advantages of the invention are apparent from the following description taken in conjunction with the accompanying drawings in which.

DETAILED DESCRIPTION OF THE INVENTION

Disclosed herein are methods and apparatus for dispensing sheet material in a material spreading machine. Application of the methods and apparatus results in a substantially uniform dispensing of the sheet material for fabrication processes.

Generally, a material spreading machine, or "spreader" is a machine useful for spreading sheet material for one or more fabric layers. The sheet material may be spread to provide for subsequent cutting of the material to a desired size. In embodiments disclosed herein, the material spreading machine is used for production of consumer goods such as garments, upholstery for residential, commercial and/or automotive furnishings and for other similar products.

Generally, the term "fabric" as used herein related to material that is supplied in roll form for use with the workstation described herein. Any other forms of material as deemed suitable may be used with the teachings herein. The term "sheet material" may be used interchangeably with the term "fabric." No limitations are to be construed by the terminology used.

Prior to discussing the material spreading machine with more detail, aspects of sheet material are introduced.

Figure 1:
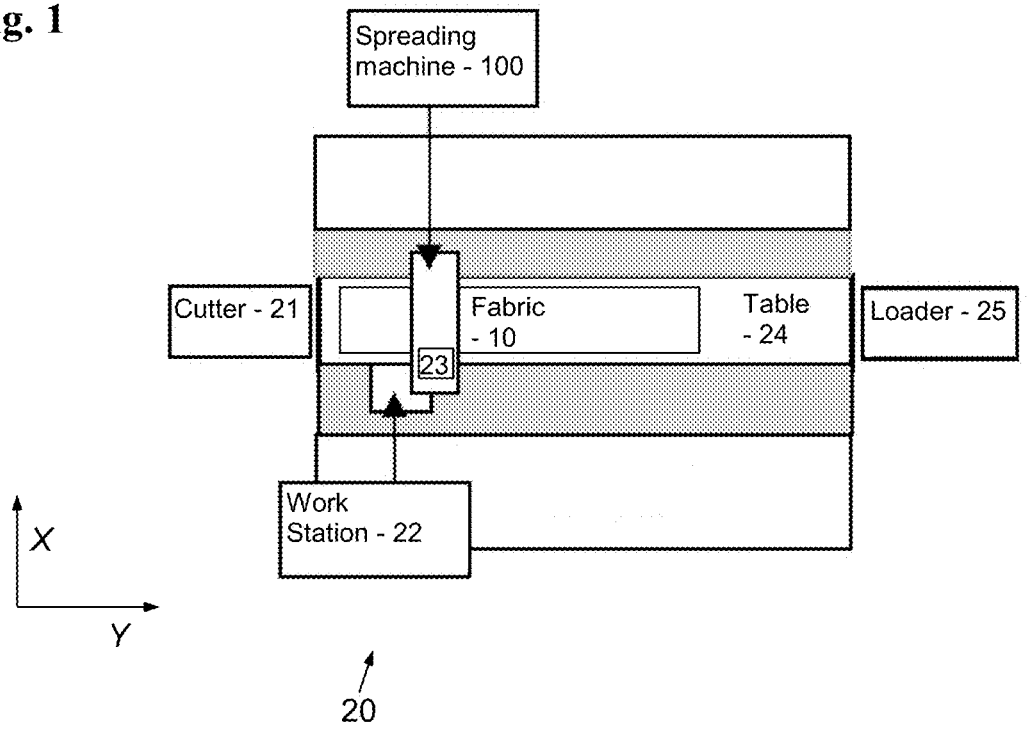
FIG. 1 is a schematic diagram depicting a work station with a material spreading machine.

Refer to FIG. 1 where aspects of an example of a system 20 for spreading sheet material is depicted. In this example, the system 20 includes a workstation 22. The system 20 includes a spreading machine 100. Generally, the system 20 includes a loader 25 for loading the fabric 10 and a cutter 21 for cutting the fabric 10. Table 24 provides a surface for loading and spreading fabric 10 that is then fed to the cutter 21. Operation of the system 20 may be controlled by an operator through controller 23.

Figure 2:
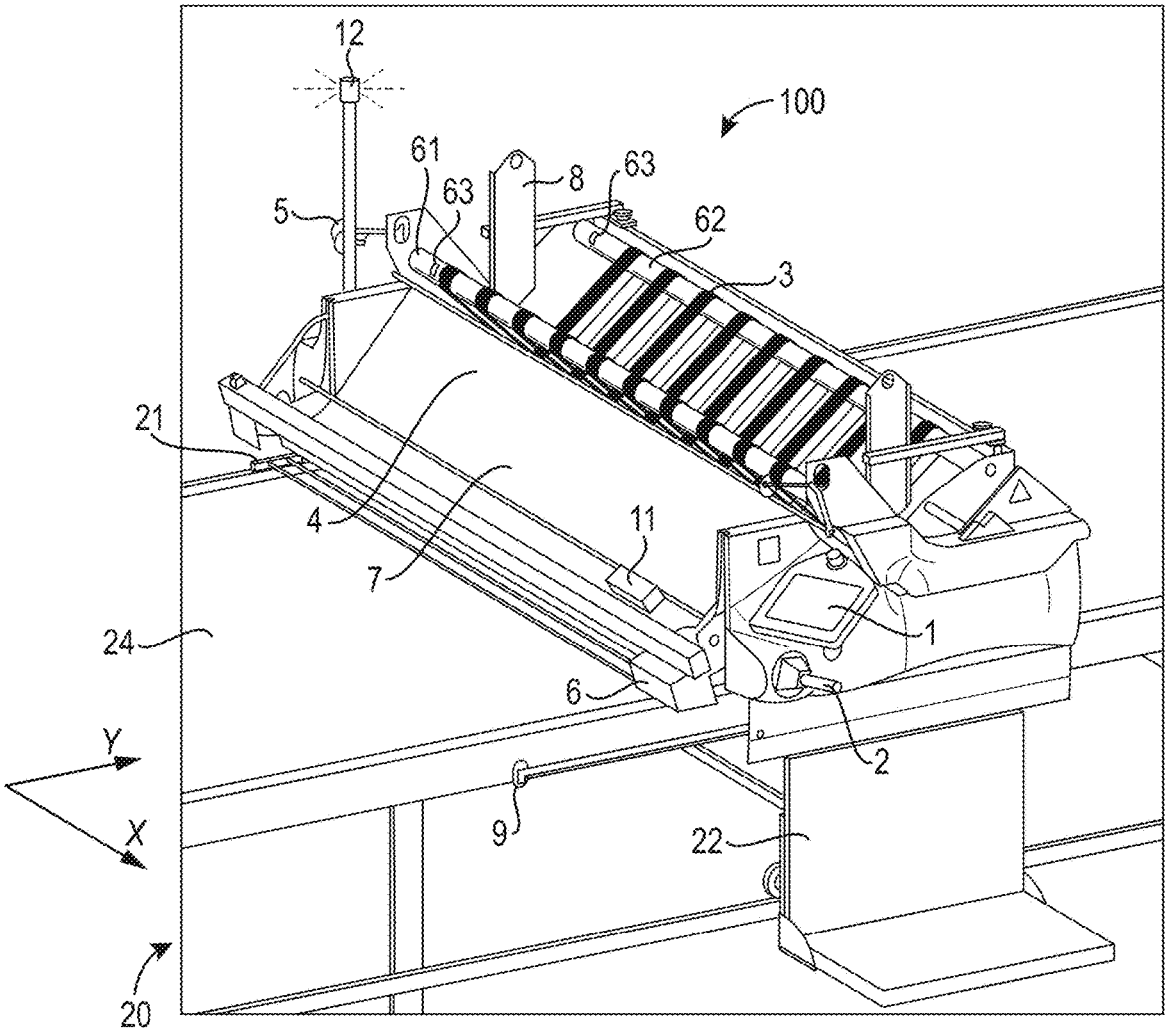
FIG. 2 is a graphic depiction of components of the material spreading machine of FIG. 1.

FIG. 2 presents a graphic depiction of the spreader 100 as a part of the system 20. In this non-limiting example, the spreader 100 is disposed over table 24 and includes various sub-components. For example, the spreader 100 includes operator panel 1. In this example, the spreader 100 is operated partly from the operator panel 1, partly from a speed throttle 2. The operator panel 1 and the speed throttle 2 communicate with the controller 23, which is in control of at least some of the sub-components of the spreader 100. The operator panel 1 includes a touch screen interface. The speed throttle 2 is used for operating the spreader 100 manually. When turning the speed throttle 2, the spreader 100 will start spreading fabric 10 in the desired direction (i.e., the Y-direction). The more the speed throttle 2 is turned, the faster the speed of the fabric 10 through the spreader 100. Included is a cradle 3. A roll of the sheet material 10 may be loaded into the cradle 3 for spreading. Also included is a dancer bar 4. The dancer bar 4 controls tension of the fabric 10. The spreader 100 may be operated with or without the dancer bar 4. Counterweights 5 may be included for adjusting the dancer bar 4. Elevator 6 may be included to position equipment as low as possible, but above the top ply of the fabric 10. A guide plate 7 may be included to guides the fabric 10 to the spreading table 24. A material roll guide 8 may be included to keep the roll of fabric 10 in a desired position. An obstacle sensor 9 may be included. In this example, the obstacle sensor 9 is disposed in the operator side of the spreader 100 and table 24. The obstacle sensor 9 will sense anything is in the way of the spreader 100 during operation. The obstacle sensor 9 may be adjustable lengthwise (in the Y-direction). Also included is edge sensor 11. Generally, the edge sensor 11 registers an edge of the fabric 10 and is useful for aligning the edge of the fabric 10. The spreader 100 may also include therewith the cutter 21. The cutter 21 cuts the fabric 10 at the end of each ply. A grinding house (not shown) on the cutter 21 may be included for sharpening the cutter 21. A warning light 12 may be included to indicate that the drive motor is active or for other signaling.

Commercially available examples of the spreader 100 include the XLs GERBER Spreaders™ available from Gerber Technology of Tolland Conn., USA. Aspects of these spreaders 100 are disclosed in greater detail in the "Getting Started Manual" printed in 2006. This manual and any accompanying documents are incorporated by reference herein in their entirety for any purpose whatsoever.

Figure 3:
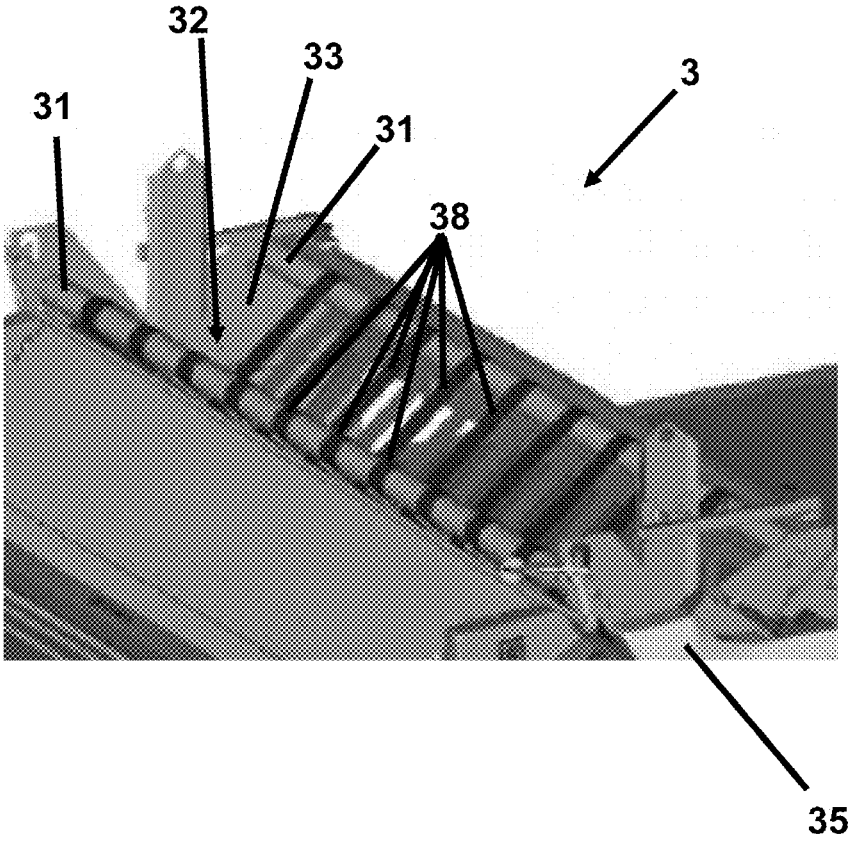
FIG. 3 is a graphic depiction of the cradle of the material spreading machine of FIG. 1 and FIG. 2.

Refer now also to FIG. 3 where aspects of the cradle 3 are shown in greater detail. As shown in FIG. 3, the cradle 3 includes a receiving area 33. The receiving area 33 is bounded by a series of drive belts 38. In this example, the belts 38 are driven by a driven roller 32. In this illustration the driven roller 32 is just out of view, and at the base of the receiving area 33. In this example, the driven roller 32 is driven by drive 35. Drive 35 may include any type of drive force as deemed appropriate. For example, a direct drive motor may be used. In this example, drive 35 includes a belt contained within a housing. The belt is driven by a motor that is remote from the cradle 3. As the driven roller 32 spins, the driven roller 32 causes the belts 38 to move about idler rollers 31. When the roll of material is placed within the cradle 3, action of the belts 38 causes the roll of material to spin as well. The spinning of the roll of material provides for dispensing of the fabric 10 to the spreader 100.

Figure 4A:
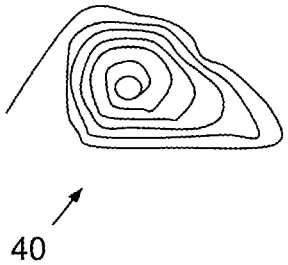
FIGS. 4A, and 4B, collectively referred to herein as FIG. 4, are depictions of conditions experienced by rolls of material dispensed with a material spreading machine outfitted with a prior art cradle.
Figure 4B:
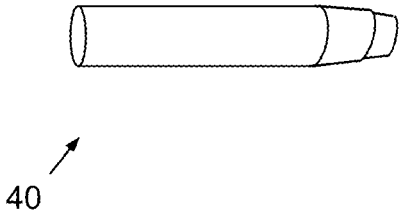
Figure 5A:
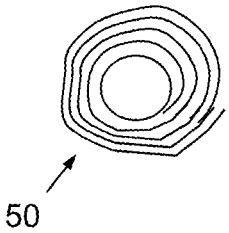
FIGS. 5A, and 5B, collectively referred to herein as FIG. 5, are depictions of desired conditions for rolls of material dispensed with a material spreading machine.
Figure 5B:
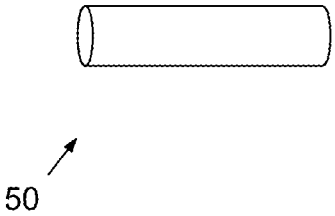

FIG. 4 provides some visual context for problems of the prior art. As shown in FIG. 4, a loosened roll of material 40 may cause "flattening" (FIG. 4A) and/or "coning" (FIG. 4B). Both flattening and coning of the roll of material 40 are conditions that cause inconsistent dispensing of fabric 10 from the roll of material 50. FIG. 5 are comparative illustrations that depict a tight roll of material 50 (FIG. 5A) that does not exhibit any coning (FIG. 5B).

Commonly, rolls of material 50 range in diameter from about 120 cm and downward to nil. A roll of material 50 may exhibit a diameter in excess of 120 cm.

Aside from dispensing fabric 10 from the roll of material under a consistent, constant tension, it is advantageous to dispense the fabric 10 in a constant orientation. Accordingly, adjustment of the positioning of the roll of material 50 during production to accommodate such goals provides for improved fabrication processes. Thus, the teachings herein provide for various embodiments of a dynamic cradle.

Figure 6A:
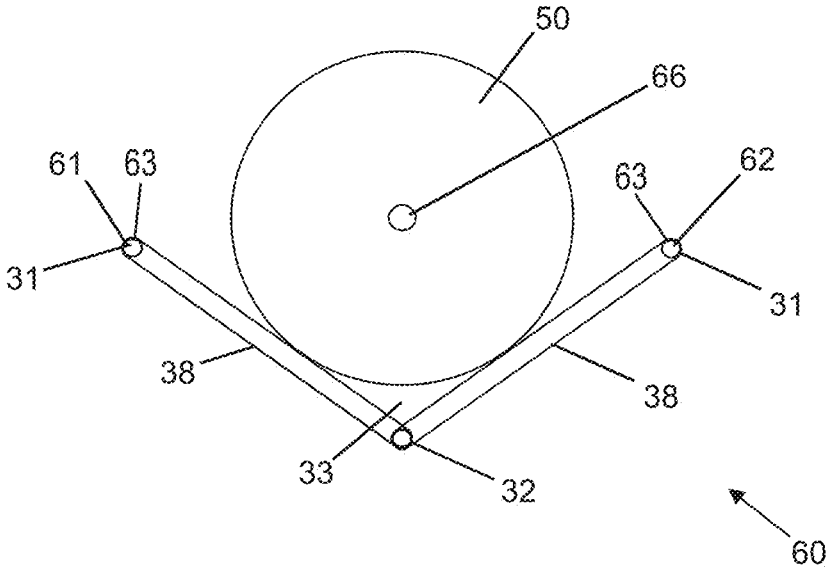
FIGS. 6A, 6B and 6C, collectively referred to herein as FIG. 6, are depictions of cradles for material spreading machines according to the teachings herein; and, FIG. 7 is a more detailed schematic depiction of the cradle of FIG. 6A.
Figure 6B:
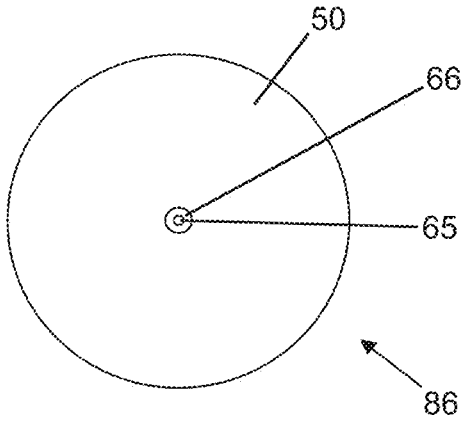
Figure 6C:
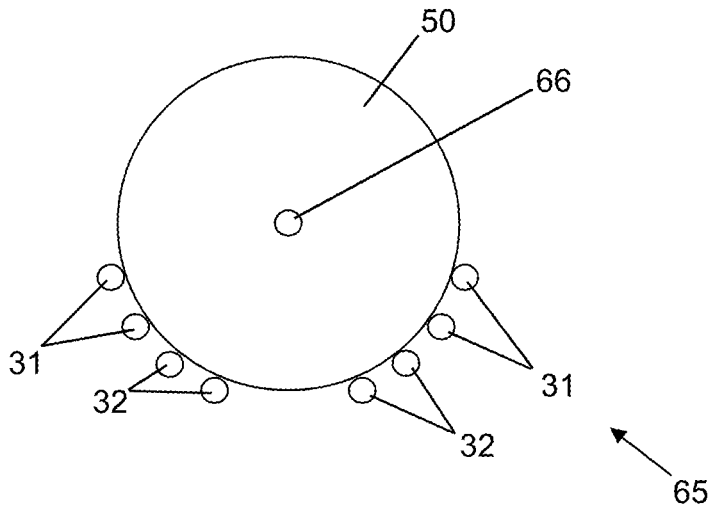

Some exemplary embodiments of a dynamic cradle are depicted in FIG. 6. FIG. 6A depicts a V-frame cradle 60; FIG. 6B depicts an open cradle 86; and, FIG. 6C depicts a driven cradle 65. Aspects of each of these embodiments are now introduced.

In FIG. 6A, the V-frame cradle 60 includes a first arm 61 and a second arm 62. The first arm 61 and the second arm 62 share a common driven roller 32. The driven roller 32 receives mechanical energy from a separate drive 35. Between the first arm 61 and the second arm 62 is the receiving area 33. The receiving area 33 receives the roll of material 50. In the center of the roll of material 50 is a hollow material core 66. The material core 66 may include a supporting structure, such as a structural tube upon which the fabric 10 is wrapped to create the roll of material 50.

In FIG. 6B, the open cradle 86 generally includes free shaft 65. Free shaft 65 may be mounted to an armature (not shown). Generally, the armature provides for articulation of free shaft 65 as the fabric 10 is dispensed from the roll of material 50. In this manner, the open cradle 86 is capable of orienting the free shaft 65 in a position suited for consistently dispensing of the fabric 10 from the roll of material 50 in a manner that provides constant tension to the spreader 100. In some embodiments, the open cradle 86 includes sensors (not shown) to provide for monitoring of the position of the roll of material 50 and communicating of position information to the controller 23. Accordingly, the controller 23 may be configured with instructions for adjusting positioning of the free shaft 65 within the open cradle 86. In FIG. 6C, the driven cradle 65 includes a plurality of rollers upon which the roll of material 50 is rested. The plurality of rollers may include at least one driven roller 32 and a series of idler rollers 31. In some embodiments, the driven cradle 65 includes sensors (not shown) to provide for monitoring of the position of the roll of material 50 and communicating of position information to the controller 23. Accordingly, the controller 23 may be configured with instructions for adjusting positioning of the plurality of rollers within the driven cradle 65. The adjustments in position of the plurality of rollers may include adjustment of the positioning of each of the rollers, and may further include adjustment of positioning of the driven cradle 65, such as by elevating the plurality of rollers as the roll of material 50 shrinks in size.

Turning back to FIG. 6A, in general, the V-frame cradle 60 may be adjusted in response to dynamics of the roll of material 50. For example, as the roll of material 50 is dispensed, the diameter of the roll of material 50 shrinks. As the roll of material 50 shrinks, the V-frame cradle 60 accommodates. That is, for example, an angle between the first arm 61 and the second arm 62 may be reduced, thus maintaining positioning of the fabric 10 dispensed from the roll of material 50 in a constant relationship with the spreader 100. Displacement of the first arm 61 and the second arm 62 may be tracked by sensors or encoders 63. In some embodiments, either the first arm 61 or the second arm 62 is held in a constant position, while the opposing arm is moved In some other embodiments, both the first arm 61 and the second arm 62 are movable and accommodate reductions in the roll of material 50.

Figure 7:
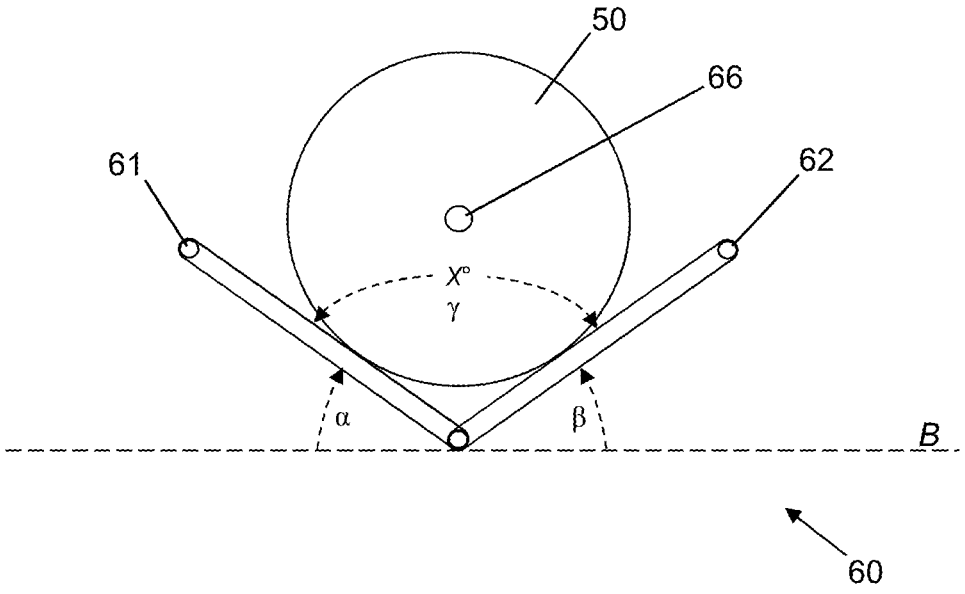

With regard to the V-frame cradle 60, refer now also to FIG. 7. In this illustration, it may be seen that orientation of the V-frame cradle 60 may be characterized by a tilt-angle, α, a lean-angle, β, and a spread angle, γ. As may be surmised, there is considerable flexibility in orienting the V-frame cradle 60, and these angular designations are merely provided to illustrate that point.

An example that includes a greater level of detail regarding control of the dynamic cradle is now introduced. In this example, the V-frame cradle 60 includes a fixed arm, and a movable arm. When the movable arm is at a maximum range from the fixed arm, it may be considered that the V-frame cradle 60 is "open."

Typically, in prior art designs, the cradle has two positions. That is, the cradle has an operating position (which looks like the V-shape) and a loading position (where a back of the cradle is lowered for loading). The V-frame cradle 60 disclosed herein provides for dynamically resizing the cradle 60 according to a size of the roll of material 50.

Generally, the V-frame cradle 60 or driven cradle 65 can accommodate rolls of material 50 of a variety of diameters, and are limited by their designed capacity. When the operator sets the cradle size to support the roll of material 50, it is assumed to be the current diameter of the roll of material 50. This could also be accomplished by an automated process that senses or measures the roll. In this embodiment, the position of the roll supports (first arm 61 and second arm 62) or (idler roller 31 and driven roller 32) is determined by sensors or values determined by motion control. These positions are compared to minimum and maximum positions, based on machine characteristics, to approximate diameter of the roll of material 50.

The dynamic tilt will automatically adjust the roll supports as the roll of material 50 shrinks. When the roll supports are told to increment, the sequencer passes in the length spread and the material thickness (which can be either entered by the operator or automatically detected). The tilt increment function will use this information to calculate a new roll support position which corresponds with the amount the roll has shrunk since the beginning of the spread. The original length of the material is calculated as:

$$OriginalLength = \frac{\pi}{4 * materialThickeness} * RollDiameter^2$$

Here the RollDiameter is the diameter from the previous calculation. In this way OriginalLength represents the size of the roll when this calculation was last performed and not the size of the roll when spreading started. Then the new diameter can be calculated, as follows:

$$NewDiameter = \sqrt{\frac{4}{\pi} * (OriginalLength - lengthSpread) * materialThickness}$$

Where (OriginalLength−lengthSpread) is at least 0.

From that new diameter a new roll support position may be calculated. Then the roll supports are commanded to the new position. With each new increment, the roll support position changes to support a smaller roll. Thus, the tilt will automatically adjust to accommodate the new size of the roll of material 50.

While, in the implementation, the calculations are performed solely in millimeters, these calculations can be performed in any units.

The foregoing methods and algorithm may be implemented by the controller 23 through execution of machine readable instructions stored on machine readable media.

Having introduced aspects of the spreader 100, some additional features are now set forth.

The dynamic cradle may be provided as a part of a spreader as originally produced. The dynamic cradle may be provided as a retrofit to existing spreader equipment. A retrofit kit may include cradle components, sensing components, motive components and an instruction set. The instruction set may be provided as software for integration with existing software used for controlling the system to be retrofit.

Generally, the controller 23 for controlling operation of the spreader 100 has one or more central processing units (processors). Processors are coupled to random access memory (RAM) (also referred to "system memory," or simply as "memory") and various other components via a system bus. The controller may include read only memory (ROM) coupled to the system bus. The ROM may include a built-in operating system (BIOS), which controls certain basic functions of computer.

The controller 23 may implement a plurality of sensors, encoders, optical devices, mechanical devices or other types of devices for, among other things, position sensing. The controller 23 may make use of position information and other process oriented information to provide for control of the system 20. Control of the system 20 may be implemented by use of servos, motors, control of voltages, switching and by other similar techniques.

The controller may include an input/output (I/O) adapter and a communications adapter coupled to the system bus. The I/O adapter generally provides for communicating with a hard disk and/or long term storage unit (such as a tape drive, a solid state drive (SSD)) or any other similar component (such as an optical drive).

The communications adapter interconnects system bus with an outside network enabling controller to communicate with other such systems. The communications adapter may be supportive of at least of one of wired and wireless communication protocols, and may communicate (directly or indirectly) with the Internet.

In some embodiments, there are two network adapters. A first network adapter connects to a customer network, and/or the Internet. The second network adapter connects to a bridge device that communicates to the edge sensor 11.

The controller is powered by a suitable power supply. Input/output devices are provided via user interface (UI) adapter. A keyboard, a pointing device (e.g., a mouse), and speaker may be included and interconnected to controller via user interface adapter. Other user interface components may be included as deemed appropriate.

Generally, the controller stores machine readable instructions on non-transitory machine readable media (such as in ROM, RAM, or in a mass storage unit). The machine readable instructions (which may be referred to herein as "software," as an "application," as a "client, a "process," a "plug-in" and by other similar terms) generally provide for functionality as will be discussed in detail further herein.

Some of the machine readable instructions stored on non-transitory machine readable media may include an operating environment. For example, and as presented herein, a suitable operating environment is WINDOWS (available from Microsoft Corporation of Redmond Wash.). Software as provided herein may be developed in, for example, SQL language, which is a cross-vendor query language for managing relational databases. Aspects of the software may be implemented with other software. For example, user interfaces may be provided in XML, HTML and the like.

It should be recognized that some control functionality as may be described herein may be implemented by hardware (such as by drive), or by software, as appropriate. Accordingly, where reference is made to implementation in one manner or another, such implementation is merely illustrative and is not limiting of techniques described. Operation of the controller may be combined with or enhanced by other technology such as machine vision, use of neural networks and through other such techniques.

A technical effect of the teachings herein is that the system maintains control of the fabric roll within the cradle mechanism. The system disclosed improves the quality of the spread by improving material alignment and reducing variations in the tension of the fabric dispensed from the spreader. The system disclosed reduces the labor and lost time associated with the operator correcting for rolls that loosen. Further, the system disclosed allows users to use larger rolls, thus eliminating the need for customers to either buy small rolls or convert large rolls to smaller rolls. Further, the teachings provide for improved feeder products where predictive roll diameter reduction is of a benefit.

The following reference numbers are used herein. While the reference numbers are used with generally used with the associated terminology, in some instances, similar terminology may be used the reference numbers.

FIG. 1
10 fabric
20 system
21 cutter
22 workstation
23 controller
24 table
25 loader
100 spreader
FIG. 2
1 operator panel
2 speed throttle
3 cradle
4 dancer bar
5 counterweights
6 elevator
7 guide plate
8 material roll guide
9 obstacle sensor
11 edge sensor
12 warning light
FIG. 3
31 idler roller
32 driven roller
33 receiving area
35 drive
FIG. 4
40 loosened roll of material
FIG. 5
50 roll of material
FIG. 6
60 v-frame cradle
61 first arm
62 second arm
66 material core
65 free shaft
86 free cradle
65 driven cradle Various other components may be included and called upon for providing for aspects of the teachings herein. For example, additional materials, combinations of materials and/or omission of materials may be used to provide for added embodiments that are within the scope of the teachings herein.

When introducing elements of the present invention or the embodiment(s) thereof, the articles "a," "an," and "the" are intended to mean that there are one or more of the elements. Similarly, the adjective "another," when used to introduce an element, is intended to mean one or more elements. The terms "including" and "having" are intended to be inclusive such that there may be additional elements other than the listed elements. As used herein, the term "exemplary" is not intended to imply a superlative example. Rather, "exemplary" refers to an embodiment that is one example of many possible examples for embodiments.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed:

1. A support for sheet material, comprising:

a frame including a first arm and a second arm, the second arm in communication with the first arm to support a roll of the sheet material there-between; and a drive roller for transporting the sheet material from the roll;

sensors for tracking displacement of the first arm and the second arm;

wherein the first arm and the second arm automatically resize the frame responsive to the sensors sensing dynamics of the roll of the sheet material to provide constant tension in the roll of sheet material by controlling a position of the roll of the sheet material.

2. The support of claim 1, wherein the first arm and the second arm are connected by the drive roller.

3. The support of claim 1, wherein either the first arm or the second arm is maintained in a constant position.

4. The support of claim 1, wherein the first arm and the second arm are movable.

5. The support of claim 1, further comprising a controller for adjusting the position of the roller within the support, the controller comprising a processor, a memory, and a communications adapter.

6. The support of claim 5, further comprising one or more sensors for:

monitoring the position of the roll of sheet material; and communicating the position of the roll of sheet material to the controller.

7. The support of claim 1, further comprising a plurality of rollers.

8. The support of claim 7, wherein the plurality of rollers includes at least one drive roller and at least one idle roller.

9. The support of claim 1, further comprising:

a tilt angle representing positioning of the first arm with respect to a surface;

a lean angle representing positioning of the second arm with respect to the surface; and a spread angle representing the positioning of the first arm with respect to the second arm.

10. The support of claim 1, further comprising an operator panel in communication with the controller.

11. The support of claim 9, wherein the operator panel comprises a touch screen interface.

12. The support of claim 1, wherein the dimensions of the roll of the sheet material include one or more of length, diameter, and material thickness of the roll of sheet material.

13. A method for support sheet material, the method comprising:

receiving, by a frame comprising a first arm and a second arm, a roll of the sheet material between the first arm and the second arm, wherein the second arm is in communication with the first arm;

transporting, by a drive roller, the sheet material; and automatically resizing, the frame by repositioning the first arm and second arm responsive to arm tracking sensors sensing dynamics of the roll of the sheet material to provide constant tension in the roll of sheet material by controlling a position of the roll of the sheet material.

14. The method of claim 13, further comprising maintaining either the first arm or the second arm in a constant position.

15. The method of claim 13, wherein the first arm and the second arm are movable.

16. The method of claim 13, further comprising adjusting, by a controller comprising a processor, a memory, and a communications adapter, the position of the drive roller within the support.

17. The method of claim 16, further comprising:

monitoring, by one or more sensors, the position of the roll of sheet material; and communicating, by the one or more sensors, the position of the roll of sheet material to the controller.

18. The method of claim 13, further comprising plurality of rollers.

19. The method of claim 18, wherein the plurality of rollers includes at least one drive roller and at least one idle roller.

20. The method of claim 13, wherein the first arm and the second arm are connected by the drive roller.

* * * * *